United States Patent [19]

Nagayama et al.

[11] Patent Number: 4,910,824

[45] Date of Patent: Mar. 27, 1990

[54] FLOOR POLISHER

[75] Inventors: Eiji Nagayama; Tetuichi Turumi; Ken Ikezawa; Yuuichi Terada; Tetu Arai; Takashi Ohta, all of Shizuoka, Japan

[73] Assignee: Amano Corporation, Yokohama, Japan

[21] Appl. No.: 271,302

[22] Filed: Nov. 15, 1988

[30] Foreign Application Priority Data

Nov. 17, 1987 [JP] Japan ..... 62-290363

[51] Int. Cl.[4] ..... A47L 11/14

[52] U.S. Cl. ..... 15/98; 15/49 R; 15/340.4; 51/177

[58] Field of Search ..... 15/49 R, 49 C, 50 R, 15/50 C, 98, 320, 340.3, 340.4, 383, 385; 51/176, 177, 178

[56] References Cited

U.S. PATENT DOCUMENTS

| | | | |
|---|---|---|---|
| 4,633,541 | 1/1987 | Block | 15/49 R |
| 4,674,142 | 6/1987 | Meili | 15/49 R |
| 4,679,271 | 7/1987 | Field et al. | 15/320 X |
| 4,757,566 | 7/1988 | Field et al. | 15/49 R |

*Primary Examiner*—Edward L. Roberts

*Attorney, Agent, or Firm*—Wenderoth, Lind & Ponack

[57] ABSTRACT

A floor polisher, while travelling, causes a pad to rotate at a high speed to polish a floor. The floor polisher has a vertically moving mechanism adapted to move the pad in the vertical direction with respect to the floor, a ground pressure adjusting mechanism adapted to maintain a ground pressure of the pad a set pressure by controlling the vertically moving mechanism, and a floor protecting mechanism adapted to actuate the vertically moving mechanism to lift the pad immediately when the travel of the floor polisher is stopped.

6 Claims, 4 Drawing Sheets

FLOOR POLISHER

BACKGROUND OF THE INVENTION

1. Field of the Invention

This invention is utilized in the technical field of sweepers for cleaning up a floor. More particularly, the invention relates to a floor burnisher or polisher provided with a pad which is rotated at a high speed to polish a floor when the floor burnisher or polisher is moved by hand or by motor.

2. Brief Description of the Prior Art

In order to clean up a floor, there is generally required a floor scrubbing operation for scrubbing a floor with a scrubbing pad after a liquid detergent is spread over the floor and wiping off dirty water produced by the scrubbing and a floor burnishing or polishing work for buffing and polishing up a floor after a wax is applied onto the floor which was scrubbed. The first-mentioned floor scrubbing operation can automatically be performed by a floor scrubber including a scrubbing pad and a squeegee for absorbing dirty scrubbing water, whereas the second-mentioned floor burnishing or polishing work can be automatically performed using a floor burnisher or a floor polisher including a polishing pad which is able to rotate at a high speed.

In the conventional floor burnisher or polisher, the ground pressure of the pad against a floor has an important significance because the polishing pad is rotated at a high speed such as about 2,000 rpm. That is, in case the ground pressure of the pad against the floor is too weak, the force for polishing the floor becomes insufficient. On the contrary, in case the ground pressure is too strong, the outer surface of the floor material is heated by frictional heat and as a result, the wax applied onto the outer surface thereof is changed to yellow. And, in some extreme cases, the floor material is damaged. However, since the conventional floor burnisher or polisher is designed such that the pad thereof is rotated at a constant speed and thus at a predetermined ground pressure, it cannot adequately follow changes in a ground pressure due to various causes such as changes in the state of a floor, wear of the pad surface and the like. Therefore, the above-mentioned problems due to too weak or too strong ground pressure always occur.

Furthermore, if the pad is kept rotating when travel of the floor burnisher or polisher is stopped, the floor will be heated by friction heat resulting in peeling of wax applied onto the floor or damage to the floor material. Therefore, when the conventional floor burnisher or polisher is stopped, the pad must immediately be stopped rotating by turning off the switch of the pad motor. However, because the pad is rotated at such a high speed of about 2,000 rpm, as previously described, even if the motor is immediately stopped, the pad is still kept rotating for some time due to the force of inertia. As a result, the floor is excessively heated or damaged by the undesirable extrarotation of the pad as mentioned.

The present invention has been accomplished in order to overcome the problems inherent in the prior art.

SUMMARY OF THE INVENTION

It is therefore an object of the present invention to provide a floor polisher, in which the ground pressure of a polishing pad against a floor is maintained always at a set pressure (constant pressure) following various changes of situation and when the polisher is stopped moving, the ground pressure of the polishing pad against the floor is released in order to prevent excessive heating and excessive pressure.

In order to achieve the above object, a floor polisher according to the present invention is provided with the following means or mechanisms.

(1) A floor polisher which allows, while travelling, a pad thereof to rotate at a high speed to polish a floor, is provided with a vertically moving means or mechanism adapted to move the pad in the vertical direction with respect to the floor.

(2) The floor polisher is provided with a ground pressure adjusting means or mechanism adapted to maintain the ground pressure of the pad alwas at a set pressure by controlling the vertically moving means or mechanism.

(3) The floor polisher is provided with a floor protecting means or mechanism adapted to actuate the vertically moving means or mechanism to lift the pad immediately when the floor polisher is stopped travelling.

The vertically moving means or mechanism used here is, for example, a motor for moving the pad in the vertical direction together with a rotating motor by revolving a threaded shaft normally or reversely. The ground pressure adjusting means or mechanism used here is, for example, an electronic control device for adjusting the ground pressure of the pad always to a set pressure by detecting a power variation (variation in electric current value) of the motor for rotating the pad and then rotating the motor for vertically moving the pad normally or reversely. Similarly, the floor protecting means or mechanism, in case the floor polisher is a self-travelling type, lifts the pad immediately when the travelling motor is stopped and, in case the floor polisher is a hand-push type, is a magnet detecting sensor, or an optical sensor in which light is utilized instead of a magnet for detecting a magnetic variation of a magnetic rotating plate mounted on an axle and transmitting, when the magnetic variation is stopped due to interruption of the movement of the floor polisher, a working signal to the pad vertically moving motor to lift the pad.

The above-described means or mechanisms function as follows.

The means or mechanism (1) moves the polishing pad in the vertical direction with respect to the floor, whereby the pad pressure can be desirably adjusted either in a weak way or in a strong way and the pad can be separated from the floor completely.

The means or mechanism (2) is capable of maintaining the ground pressure of the pad always at a set pressure with respect to the floor by adequately controlling the vertically moving means of mechanism irrespective of an occurrence of changes in the floor, pad surface, etc. Accordingly, there can be overcome such problems as an insufficient polishing due to too weak ground pressure, an adverse affect on the floor due to too strong ground pressure, or the like. Therefore, the floor can always be polished beautifully .

The means or mechanism (3) lifts the pad from the floor immediately when the floor polisher stops moving. Accordingly, there can be overcome such problems as an excessive polishing of the floor by the pad when the floor polisher is stopped. Therefore, the floor is not excessively heated nor damaged due to the excessive polishing.

As described in the foregoing, by virtue of the provision of the above-described means or mechanisms, the various problems inherent in the prior art can effectively be overcome.

The above and other objects, characteristic features and advantages of the present invention will become more apparent to those skilled in the art as the disclosure is made in the following description of a preferred embodiment of the present invention, as illustrated in the accompanying drawings, wherein:

DETAILED DESCRIPTION OF THE EMBODIMENT

One preferred embodiment of a floor polisher according to the present invention will be described with reference to the accompanying drawings.

Figure 1:
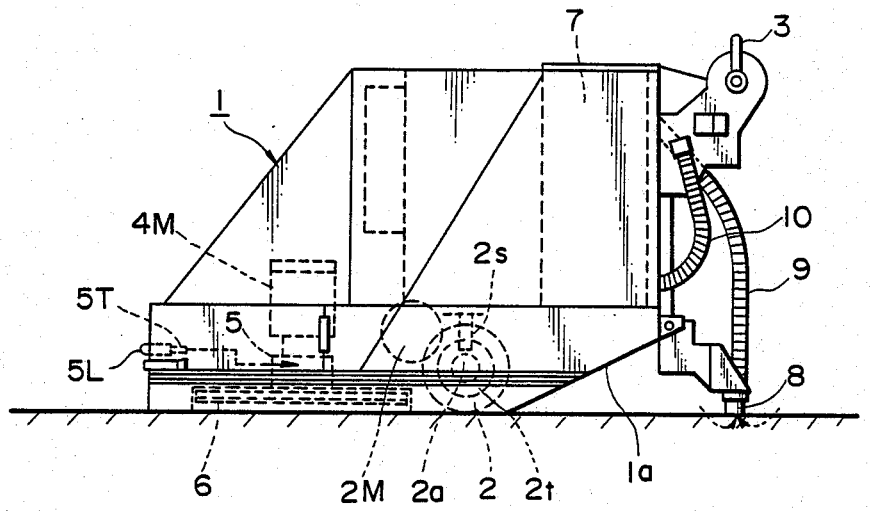
FIG. 1 is a side view showing one example of a floor polisher according to the present invention.

In FIGS. 1 though 3, 1 denotes a vehicle body of a self-travelling type floor polisher which also has function to scrub a floor. The vehicle body 1 is moved on a floor by wheels 2 which are rotated by a travelling motor 2M (or motor for running). 2*a* denotes an axle for the wheels 2. 3 denotes an operating handle mounted on a rear part of the vehicle body 1. 4M denotes a pad motor disposed at the inner side of a front portion of the vehicle body 1. A pad rotating mechanism comprises the motor 4M and a speed reducer 5. The speed reducer 5 is designed such that by operating a speed shift lever 5 disposed at one side portion of the vehicle body 1, the speed of rotation of the pad motor 4M can be shifted between two stages, i.e., 500 rpm suitable for scrubbing and 2,000 rpm suitable for polishing. The shifted state corresponding to the speed of rotation of the pad motor 4M is displayed on a control panel (not shown) disposed at a portion of the handle 3. 6 denotes a pad rotating chamber formed at a bottom surface of a front portion of the vehicle body 1. Disposed within the pad rotating chamber 6 is a pad holder 5*a* which is connected to the speed reducer 5. 5T denotes a turn-over switch which is turned on so that a motor for moving the pad in the vertical direction as will be described can be activated only when the shift lever 5L is shifted to the polishing side. 7 denotes a dirty water tank mounted within the vehicle body 1. The dirty water tank 7 is provided at its back with a scrubbing liquid tank (not shown). 8 denotes a squeegee disposed at a rear portion of the vehicle body 1. Dirty water produced on the floor by scrubbing squeegee 8, then passes through a hose 9 and is collected into the dirty water tank 7. 10 denotes a dirty water discharge hose mounted on the dirty water tank 7.

Figure 2:
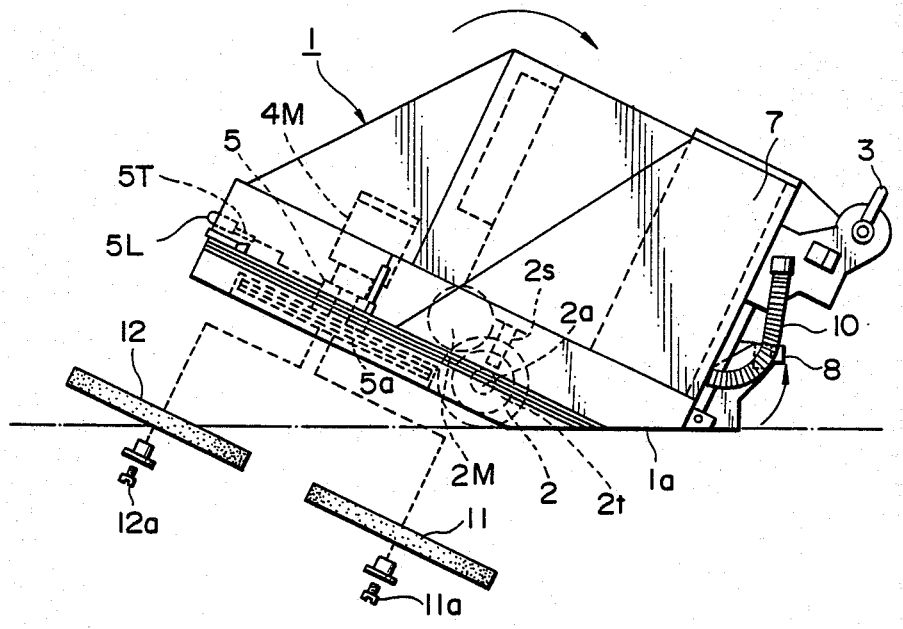
FIG. 2 is a side view showing the floor polisher of FIG. 1 but when a pad thereof is exchanged.

FIG. 2 illustrates a different state of the vehicle body 1 where the whole of the vehicle body 1 is pushed down so that the same is inclined along the inclined surface 1*a* of the bottom portion. A scrubbing pad 11 and a polishing pad 12 can be attached to and removed from the vehicle body 1 when the vehicle body 1 is held in its inclined state as illustrated. 11*a* and 12*a* respectively denote screws for positioning the pads 11 and 12. The centers of the respective pads 11 and 12 are established by the screws 11*a* and 12*a* and exchangably mounted within the pad holder 5*a* of the speed reducer 5 by an adhesive tape (not shown). It is noted, however, that the illustrated mounting structure is only one example of the structure, and the pads 11 and 12 may be mounted by any other suitable means. The scrubbing and polishing pads 11 and 12 employed in this embodiment are respectively formed of a coarse fiber and a fine fiber. However, a brush pad may be used as the scrubbing pad 11.

Figure 3:
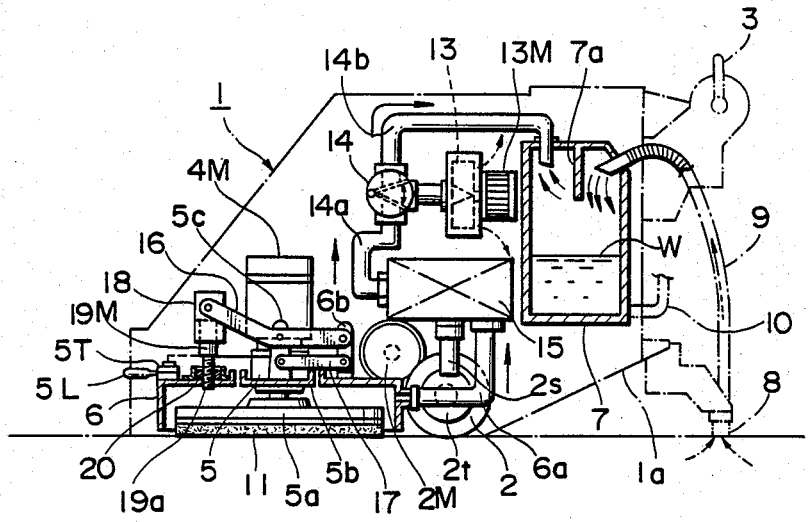
FIG. 3 is a side view showing the internal structure thereof.

Next, in FIG. 3, 13 denotes a blower mounted on the vehicle body 1. The blower 13 is rotated by a blower motor 13M to exhibit an absorbing function. The blower 13 is provided with an absorbing pipe which is bifurcated at a portion of an electromagnetic switch valve 14 into a dust absorbing pipe 14*a* and a dirty water absorbing pipe 14*b*. The dust absorbing pipe 14*a* is connected to a filter box 15, whereas the dirty water absorbing pipe 14*b* is connected to the dirty water tank 7. In the figure, 6*a* denotes a pipe for connecting the filter box 15 and the pad rotating chamber 6 with each other, and 7*a* denotes a partition panel disposed in a vertically erected posture within the dirty water tank 7.

The electromagnetic switch valve 14 is switched in association with the shifting operation of the speed shift lever 5L. When the speed shift lever 5L is set in the scrubbing speed position, the electromagnetic valve 14, upon closing the dust absorbing pipe 14, directs the suction of the blower 13 to the squeegee 8 through the dirty water tank 7 and hose 9 and collects a scrubbing dirty water produced by the scrubbing into the dirty water tank 7 as illustrated. On the other hand, when the speed shift lever 5L is set in the polishing speed position, the electromagnetic valve 14 is switched to direct the suction of the blower 13 into the pad rotating chamber 6 through the filter box 15 and collects waste thread, fine powder dust, etc., which are produced by the polishing rotation of the polishing pad 12, into the filter box 15.

Figure 4:
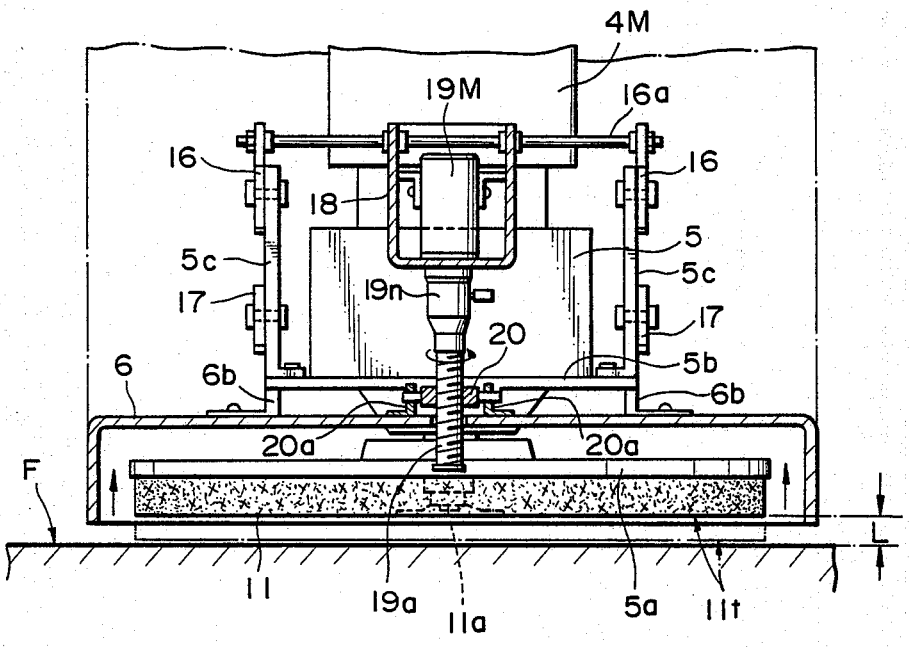
FIG. 4 is an enlarged front sectional view of an important portion thereof.

Furthermore, in FIGS. 3 and 4, 5*b* denotes a movable plate with the pad mounting mechanism mounted thereon, and 5*c*, 5*c* denote supporting brackets each provided at each side of the movable plate 5*b*. Likewise, 6*b* denote fixing brackets on an upper surface of the pad rotating chamber 6 (fixing chassis), 16, 16 denote rotatable operating arms which are swingably disposed between the brackets 5*c* and 6*b*, and 17 denote parallel movement arms which are swingably disposed between the brackets 5*c* and 6*b*. The arrangement is such that the pad rotating mechanism (motor 4M and speed reducer 5) mounted on the movable panel 5*b* is vertically operated along the central portion of the pad rotating chamber 6 while being supported by the respective arms 16 and 17.

16*a* denotes a mounting shaft stretched between upper ends of the operating arms 16 which are bent in a generally inversed V shape. The mounting shaft 16*a* is provided at its intermediate portion with a casing 18 hanging down therefrom and containing therein a pad vertically moving motor 19M which is activated only when the shift lever 5L is shifted to the polishing side. A lower end portion of a rotating threaded shaft 19*a* mounted on the motor 19M through a thrust bearing 19*n* in such a manner as to be directed downward is threadedly engaged in a nut 20 secured to the upper surface of the pad rotating chamber 6 by mounting plates 20*a*, 20*a*. The foregoing structure constitutes the pad vertically moving mechanism.

Therefore, according to the vertical moving mechanism, when the vertically moving motor 19M is rotated normally, the threaded shaft 19*a* moves through the nut 20 and the vertically moving motor 19M is lowered. Accordingly, the movable plate 5*b* is lowered by the operating arms, 16 in association therewith and the polishing pad 12 mounted on the pad rotating mechanism is also lowered to increase the ground pressure against the floor. On the other hand, when the vertically moving motor 19M is rotated reversely, the pad rotating mechanism is lifted to reduce the ground pressure against the floor and, as a result, the pad 12 can be separated from the floor.

The reason why the polishing pad 12 is designed so as to be vertically movable is that the pad pressure can be adjusted in accordance with the state of the floor or the pad surface. In the case of an automatic adjustment, a reference value is adjustable to three stages of high, intermediate and low as will be described, whereas in the case of a manual adjustment, the value is adjustable according to an indicator. In the present invention, the pad pressure is held always to a set value by the ground pressure adjusting device.

That is, in the present invention, the power variation (electric current value variation) of the pad motor 4M, which is varied depending on the strength or weakness of the ground pressure of the pad 12 against the floor, is detected by a pad pressure detector 4T (see FIG. 7) such as, for example, a wattmeter or an amperemeter. When the detected value exceeds an allowable range or tolerance, the vertically moving motor 19M is rotated reversely by a control device to lift the pad 12 so that the pad pressure is adjusted so as to reduce it until it is coincident with the set value. On the contrary, when the detected value is lowered below the allowable range or tolerance, the pad 12 is lowered by rotating the pad vertically moving motor 19 so that the pad pressure is raised to the set value.

Furthermore, in the present invention, if the vehicle body 1 is stopped when the floor is polished by the polishing pad 12, the floor protecting mechanism works such that the pad 12 is immediately lifted from the floor. As a result, the floor is protected from being damaged.

Figure 5:
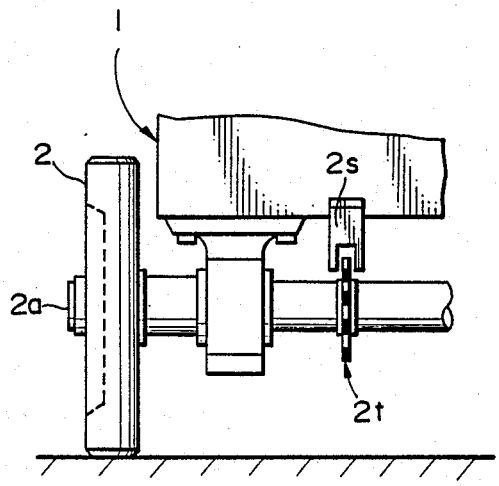
FIG. 5 is a schematic view showing one example of a floor protecting mechanism.
Figure 6:
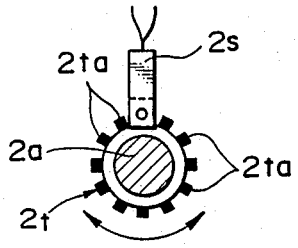
FIG. 6 is a side sectional view of an important portion thereof.

That is, in a self-travelling type polisher, as soon as the travelling motor 2M is turned off, the vertically moving motor 19M is immediately rotated reversely to lift the pad 12, whereas in a hand-push type polisher, a protecting mechanism as illustrated in detail in FIGS. 5 and 6 protects the floor.

In FIGS. 5 and 6, 2*t* denotes a magnetic rotating plate which a plurality of magnetic plates 2*ta* are spacedly arranged in the circumferential direction thereof. The rotating plate 2 is mounted on an axle 2*a* and rotated when the vehicle body 1 travels. On the other hand, 2*s* denotes a magnetic sensor for determining whether the rotating plate 2*t* is being rotated. The sensor 2*s* detects the rotating state of the axle 2*a*, i.e., the travelling state of the vehicle body 1, by sensing magnetic variation caused by the rotation of the rotating plate 2*t*. When the vehicle body 1 is stopped, the sensor 2*s* sends a command for a reverse rotation to the pad vertically moving motor 19M immediately, so that the pad 12 is lifted from the floor.

In the above-described embodiment, the speed of rotation of the pad motor 4M is shifted between two stages by the speed reducer 5. Alternatively, the speed of rotation of the pad motor 4M may be shifted between two stages by a speed change gear using a belt pulley.

Figure 6A:
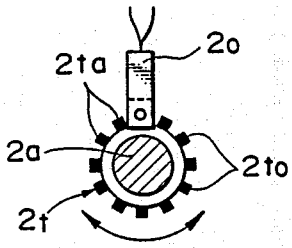
FIG. 6*a* is a view similar to FIG. 6 of an alternative structure.

In the present invention, there may be employed instead an optical sensor 2*c* shown in FIG. 6*a* instead of the magnetic sensor 2*s* for detecting plates 2 to on rotating plate 2*t* for determining whether the axle 2*a* is being rotated.

Figure 7:
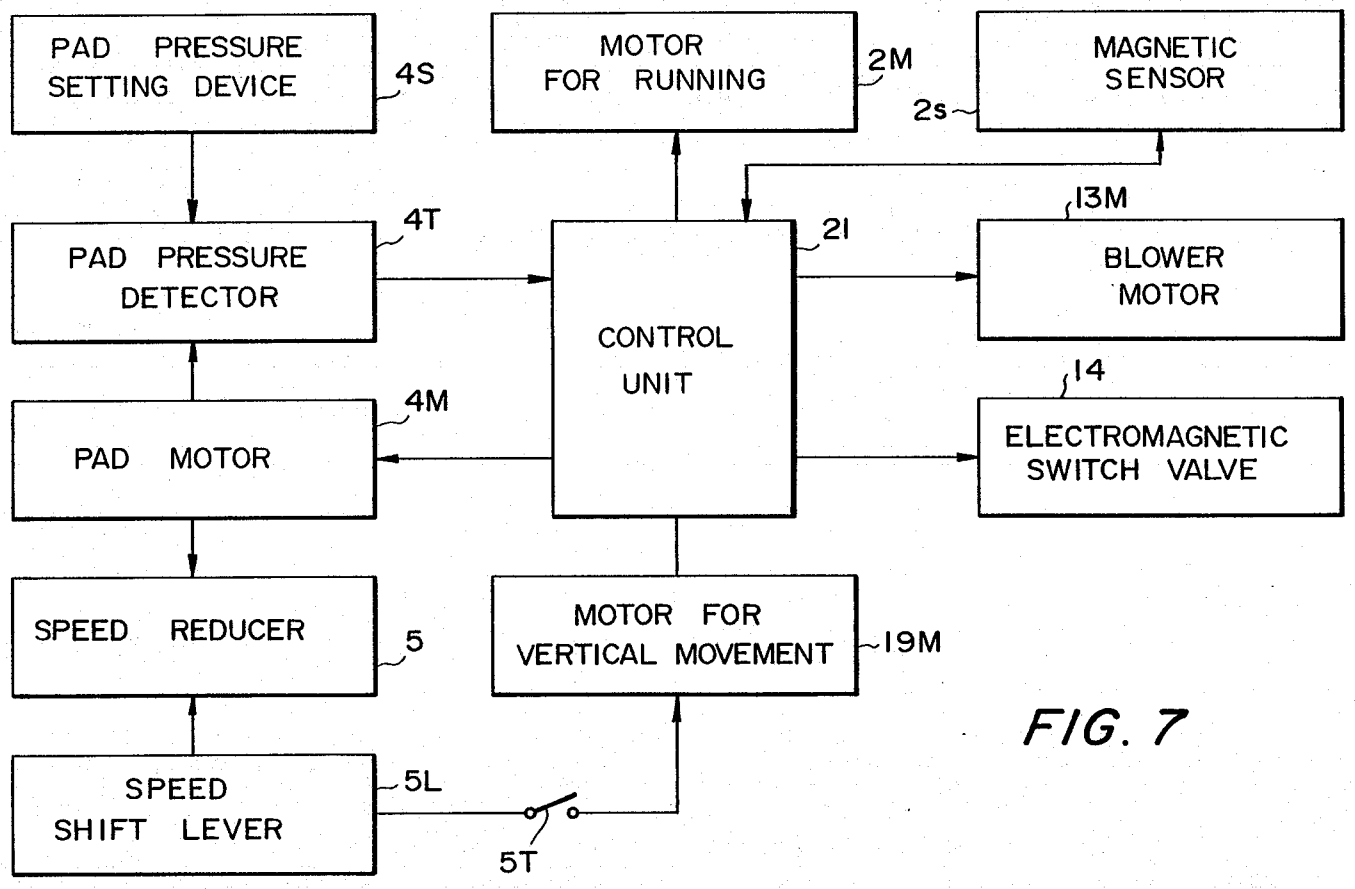
FIG. 7 is a block diagram showing an electric drive and control means.

FIG. 7 is a block diagram showing the electric control and operation means of a floor polisher according to the present invention. A control portion 21 provided with a control panel portion and an electronic instrument such as a microcomputer is connected with the afore-mentioned various motors 2M, 4M, 13M and 19M, the electromagnetic switch valve 14, the magnetic sensor 2*s* and the pad pressure detector 4T. The pad pressure detector 4T is connected with a pad pressure setting device 4S, and the vertically moving motor 19M is connected with a turn-over switch 5T. The function of each component is the same as previously described.

Since the present invention is constituted in the manner as described, when a floor is to be scrubbed, the speed shift lever 5L is operated first to set the pad rotating mechanism to a scrubbing speed (500 rpm), and the scrubbing pad 11 is attached to the rotating mechanism. The floor is scrubbed by the scrubbing pad 11 while scattering a liquid detergent onto the floor. Since the absorbing force of the blower is acting on the squeegee side when the floor is scrubbed, the dirty water formed on the floor during scrubbing can be absorbed and cleaned by the squeegee.

In order to polish the floor, which was scrubbed by the scrubbing pad 11 and absorbed by the squeegee, with a wax, the vehicle body 1 is inclined, as shown in FIG. 2, and then the scrubbing pad 11 is exchanged for the polishing pad 12. Then, the speed shift lever 5L is operated to set the speed of rotation to a polishing speed (2,000 rpm). If the floor with a wax applied thereon is buffed by the polishing pad 12 rotating at a speed of 2,000 rpm, the floor can be finished in a brilliant and beautiful finish. Since the absorbing force of the blower acts on the pad rotating chamber 6 side during the polishing work, the tiny waste threads, fine powder dust, etc., which are produced by the buffing, are drawn into the filter box 15 due to the suction force of the blower.

When the shift lever 5L is shifted to the polishing side, the turn-over switch 5T is turned on to actuate the vertically moving mechanism, the ground pressure adjusting mechanism and the floor protecting mechanism. Therefore, the polishing pad 12 is contacted with the floor always under a suitable pressure for buffing so that the polishing work can be performed without trouble. In addition, since the pad 12 is immediately lifted from the floor when the vehicle body 1 is stopped, an excessive heating due to the extra rotation of the pad during the stopping time of the vehicle body 1 can be prevented from occurring, whereby the floor can be effectively prevented from being damaged.

In the illustrated embodiment, the polisher is also used as a scrubbing device. Of course, the polisher may have only the polishing function without the scrubbing function.

As described in the foregoing, in a floor polisher according to the present invention, since the ground pressure of the polishing pad can be always maintained at a set value, there can be overcome such problems as that the polishing work on a floor becomes insufficient due to too weak ground pressure and the floor is damaged due to too strong ground pressure. Moreover, the pad pressure can be adjusted by itself following the changes in state of the floor or pad, and therefore, the floor can be polished beautifully. In addition, since the pad is immediately lifted from the floor when the vehicle body is stopped, the floor can also be prevented from being damaged by the extra rotation of the pad even after the vehicle body is stopped and the polishing work can be performed smoothly. As seen in the foregoing, a floor polisher according to the present invention is indeed an epoch making device for cleaning a floor.

From the foregoing it will be seen that a novel and efficient floor polisher has been described herein. The descriptive and illustrative materials employed herein are utilized for purposes of exemplifying the present invention and not in limitation thereof. Accordingly, numerous modifications of the present invention will occur to those skilled in the art without departing from the spirit of the present invention. Moreover, it is to be understood that certain features of the present invention can be used to advantage without a corresponding use of other features thereof.

What is claimed is:

1. A floor polisher having a pad and means for causing, while the floor polisher is travelling, said pad to rotate at a high speed to polish a floor, said floor polisher comprising:

a vertically moving mechanism adapted to move said pad in the vertical direction with respect to the floor;

a ground pressure adjusting mechanism connected to said vertically moving mechanism for maintaining a ground pressure of the pad at a set pressure by controlling said vertically moving mechanism; and a floor protecting mechanism connected to said vertically moving mechanism for controlling said vertically moving mechanism to lift the pad immediately when the travel of the floor polisher is stopped.

2. A floor polisher as claimed in claim 1, wherein said vertically moving mechanism is a reversible motor for moving the pad in the vertical direction by revolving a threaded shaft normally or reversely.

3. A floor polisher as claimed in claim 1 or claim 2, wherein said ground pressure adjusting mechanism is an electronic control device for adjusting the ground pressure of the pad so that it is always a set pressure by detecting a power variation of the motor for rotating the pad and then rotating the motor for vertically moving the pad normally or reversely according to the detected value.

4. A floor polisher as claimed in claim 1 or claim 2, wherein said floor polisher is a self-travelling type having a travelling motor, and said floor protecting mechanism comprises means for operating said vertically moving mechanism for lifting the pad immediately when the travelling motor is stopped.

5. A floor polisher as claimed in claim 1 or claim 2, wherein said floor polisher is a hand push type, and said floor protecting mechanism comprises a magnet detecting sensor and a magnetic rotating plate rotatable by the movement of the floor polisher and the rotation of which is detected by said sensor, and said sensor being connected to said vertically moving mechanism to operate said vertically moving mechanism to raise the pad when said sensor detects the stopping of rotation of said rotating plate.

6. A floor polisher as claimed in claim 1 or claim 2, wherein said floor polisher is a hand push type, and said floor protecting mechanism comprises an optical sensor and a rotating plate rotatable by the movement of the floor polisher and the rotation of which is detected by said sensor, and said sensor being connected to said vertically moving mechanism to operate said vertically moving mechanism to raise the pad when said sensor detects the stopping of rotation of said rotating plate.

* * * * *